United States Patent [19]

Mask

[11] Patent Number: 4,509,746

[45] Date of Patent: Apr. 9, 1985

[54] ARTICULATED EXERCISE BENCH WITH LEG CURL DEVICE

[76] Inventor: Ernest D. Mask, 311 Marion La., Lee's Summit, Mo. 64063

[21] Appl. No.: 515,305

[22] Filed: Jul. 19, 1983

[51] Int. Cl.[3] ..... A63B 21/00

[52] U.S. Cl. ..... 272/134; 272/117; 272/144

[58] Field of Search ..... 272/117, 134, 144, 122, 272/116

[56] References Cited

U.S. PATENT DOCUMENTS

| | | | |
|---|---|---|---|
| 1,158,779 | 11/1915 | Bolger | 272/134 X |
| 2,724,428 | 11/1955 | Sellner | 272/144 X |
| 2,855,199 | 10/1958 | Noland et al. | 272/134 X |
| 3,120,954 | 2/1964 | Apostol | 272/134 X |
| 3,761,081 | 9/1973 | Simmons | 272/144 |
| 4,098,502 | 7/1978 | Faust | 272/134 X |
| 4,353,547 | 10/1982 | Jenkinson | 272/134 X |

*Primary Examiner*—Richard J. Apley
*Assistant Examiner*—William R. Browne
*Attorney, Agent, or Firm*—Schmidt, Johnson, Hovey & Williams

[57] ABSTRACT

An adjustable leg exercise device is provided which is easily adjustable between a sitting position and a prone position, whereby the body is placed in an ideal position for exercising the quadricep muscles and hamstring muscles respectively. The device preferably includes a floor-engaging support frame and a weight-receiving exercise unit pivotally secured adjacent the upper portion of one end of the support frame. The exercise unit includes a weight-receiving structure for selectively attaching different amounts of weights, to vary the resistance to the pivoting action. Additionally, the unit also presents a pair of leg-engaging regions, the first region positioned for use in the quadricep exercise while the second region is positioned for use in the hamstring exercise. An articulated, flat, padded bench is pivotally secured to the upper portion of the frame, with the bench-frame pivotal connection located adjacent the frame-exercise unit pivotal connection. The bench includes two portions hingedly interconnected such that the bench can be positioned in a sitting use position for the quadricep exercise or alternatively, positioned into a gabled, prone use position for the hamstring exercise. Advantageously, the frame includes supports for holding the bench in either of the selected positions.

9 Claims, 9 Drawing Figures

Fig. 7
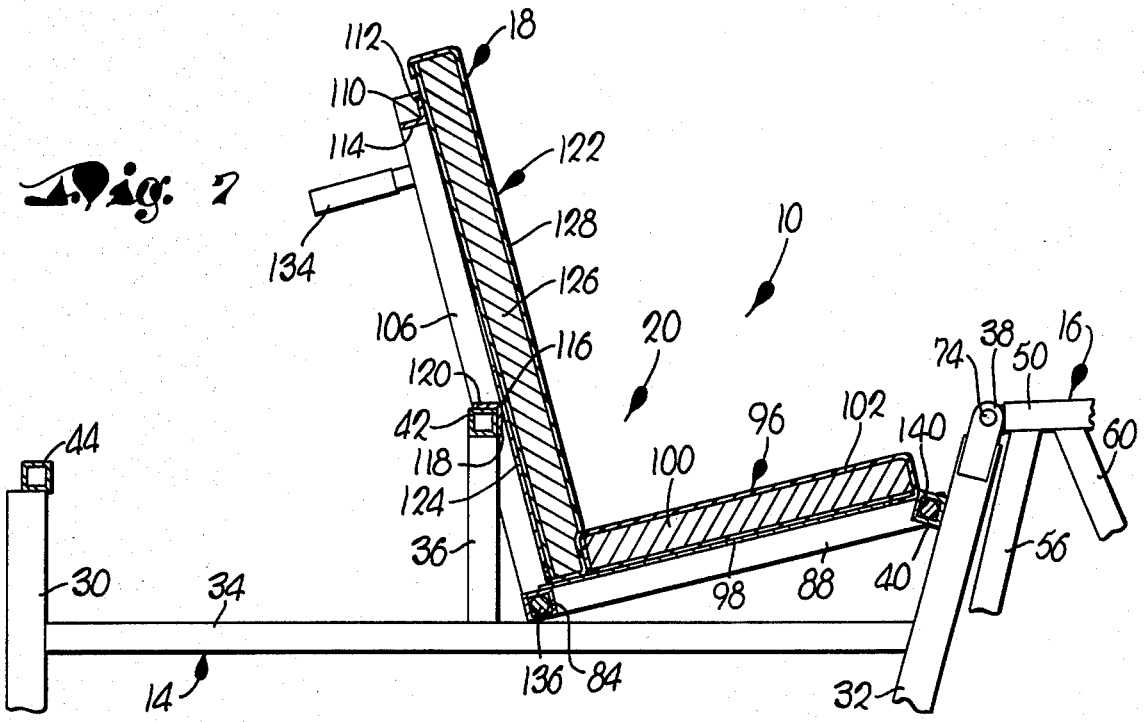
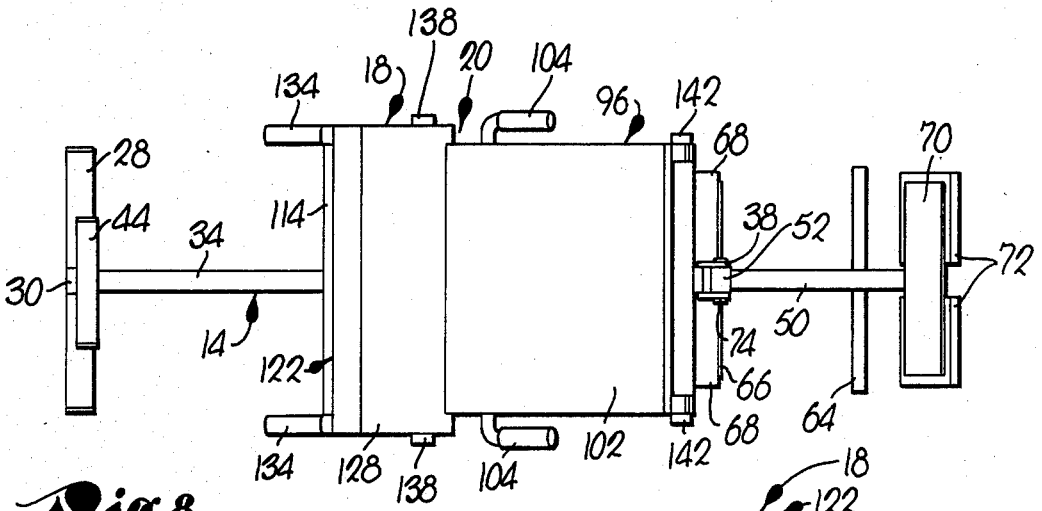
Fig. 8
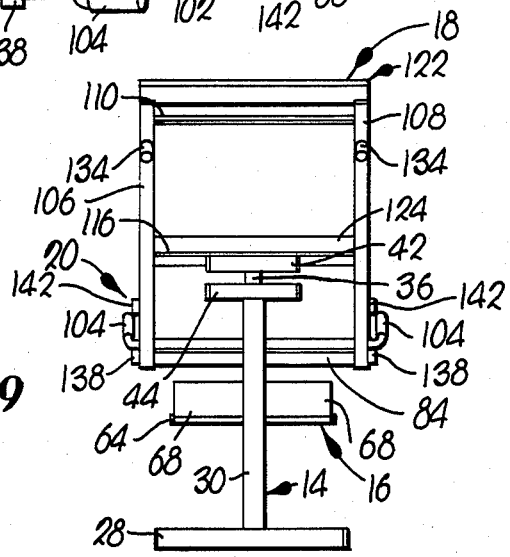
Fig. 9

ARTICULATED EXERCISE BENCH WITH LEG CURL DEVICE

BACKGROUND OF THE INVENTION

1. Field of the Invention

This invention relates to an adjustable leg exercise device which is easily adaptable into a sitting use configuration for exercising the quadricep muscles or, alternatively, adaptable into a prone use position for exercising the hamstring muscles. Of a particular advantage, is the incorporation of a two-position bench into a single exercise device, whereby the body can be placed in an ideal position for the desired exercise, while only the cost of a single unit is incurred. More particularly, the invention hereof is concerned with an exercise device including a floor-engaging frame for supporting the device, an exercise unit pivotally secured to one end of the frame and having a pair of leg-engaging regions for use during exercise, and an articulated bench which can be alternatively positioned and held into a sitting position or a prone position.

2. Description of the Prior Art

A number of leg exercise devices have been proposed in the past which allow for the alternative exercise of either the quadricep muscles or the hamstring muscles. These devices have typically included a flat, rigid, elongated, padded table support on the floor, with an exercise unit pivotally secured to the device at one end of the table. In such devices, the resistance of the pivoting unit is regulated by either placing different amounts of conventional free weights on the unit itself or attaching the pivoting unit by way of a cable and pulley arrangement to a set of vertically mounted, rail guided, selectable weights. In either case, these pivoting units of past devices have typically incorporated two separate, spaced apart leg-engaging regions. The lowermost of these leg-engaging regions is used to exercise the quadriceps by sitting on the end of the bench adjacent the pivoting unit and rotating the unit with the legs through an arc from a lowermost, vertical position, to an upper position approximately level with the bench. To exercise the hamstrings with such a device, a person would lay on the bench in a prone position with the back of the ankles engaging the uppermost leg-engaging region of the pivoting unit. The pivoting unit is then rotated through an arcuate path from a lower position, approximately level with the bench, to an upper position vertically disposed above the bench.

While in past leg exercise devices only one device is required for exercising both the quadricep muscles and the hamstring muscles, these devices have proved deficient in optimally exercising the desired muscle group. The use of a straight bench in past devices has compromised the exercise value of both the hamstring and quadricep exercises. In either exercise, the pivoting unit is not positioned relative to the body for obtaining the optimum exercise arc of the unit for the desired exercise. Additionally, the body is positioned on the flat bench in such a manner to allow other muscle groups to significantly take part in the exercise, thereby de-emphasizing the benefit to the quadricep or hamstring muscles.

In response to these known deficiencies of exercising with a single leg exercise device for both the quadricep and hamstring muscles, new devices have been proposed which more ideally position the body for the desired exercise. That is, a quadricep exercise device has been developed which incorporates a chair rotated slightly backwards in place of the flat bench of the previously used devices. Such a quadricep exercise device positions and supports the body so that exercise of the quadricep muscles is emphasized and other muscle groups are de-emphasized. Further, the slightly backwards inclined position of the chair of the device allows the pivoting unit to be rotated through an arcuate path greater than 90° of rotation. Thus, the quadricep exercise begins with an acute angle formed between the tibia and femur of the leg, and ends with the leg extended and oriented past the horizontal.

A second, individual exercise device has been developed for exercising the hamstring muscles and includes an upwardly bowed bench in place of the flat bench used in previous devices. By laying in a prone position on such a hamstring bench, with the stomach approximately positioned over the bend in the bench, it has been found that the body is thereby positioned for optimally exercising and defining the hamstring muscles. Thus, for example, the incline of the bench de-emphasizes the kneecaps as a fulcrum point and additionally, de-emphasizes the musculature of the buttocks during the hamstring exercise. While these two, separate, leg exercise devices have proved effective in optimally addressing the quadricep and hamstring muscles respectively, it is, as might be expected, more expensive to purchase individual leg exercise devices for a particular muscle group. Thus, in the past, the purchaser has been presented with the choice of purchasing a single machine for exercising both the hamstring and quadricep muscles, but which is deficient in properly positioning the body for optimum exercise, or the purchaser may buy a separate leg exercise device for each exercise, which is an expensive alternative.

SUMMARY OF THE INVENTION

The problems involved with the past leg exercise devices as outlined above are in large measure solved by the leg exercise device in accordance with the present invention. That is to say, the device hereof is a single unit which is adjustable between a sitting position, configured for the optimum exercise of the quadricep muscles, and a prone position, configured for the optimum exercise of the hamstring muscles.

The leg exercise device of the present invention broadly includes a frame for supporting the device, an exercise unit pivotally mounted to the frame, and an articulated bench pivotally secured to the frame and adjustable between a first, sitting use position and a second, prone use position. The pivotal exercise unit advantageously presents one or more leg-engaging regions and additionally includes structure for adjusting the pivoting resistance of the unit. The articulated bench presents a generally flattened, first portion having one end pivotally secured to the frame and the other end hingedly interconnected to a generally flattened, second position. In the first, sitting use position, the first and second portions of the bench and transversely oriented relative to each other. In the second, prone use position the first and second portions are oriented to present a gabled configuration. Advantageously, the device includes structure to alternately secure the bench in either the first or second positions.

In particularly preferred forms, the frame includes first, middle and second uppermost, spaced-apart, substantially coplanar, upright supports. The bench first portion is pivotally coupled adjacent the upper end of the first support and the exercise unit is pivotally mounted adjacent thereto, but extending away from the bench. In the first, sitting position, the bench is supported by the pivotal coupling of the bench first portion to the frame first support and the bench second portion engaging the frame middle support. Advantageously, the bench second portion includes structure thereon for securement to the second support and the distance along the bench between the bench pivotal coupling to the frame and the securement structure is greater than the linear distance between the bench pivotal coupling to the frame and the second frame support. This frame and bench cooperative configuration permits the bench to be slightly upwardly oriented presenting a gabled configuration and held in place in the second, prone position. In this second position the bench is supported by the pivotal coupling of the bench to the frame first support and the structure securing the second bench portion to the frame second support.

BRIEF DESCRIPTION OF THE DRAWINGS

FIG. 7 is a partial vertical sectional view of the device in the first position;

FIG. 8 is a plan view of the device of the present invention in the first position; and FIG. 9 is a rear elevational view of the device illustrated in FIG. 8.

DESCRIPTION OF THE PREFERRED EMBODIMENT

Figure 1:
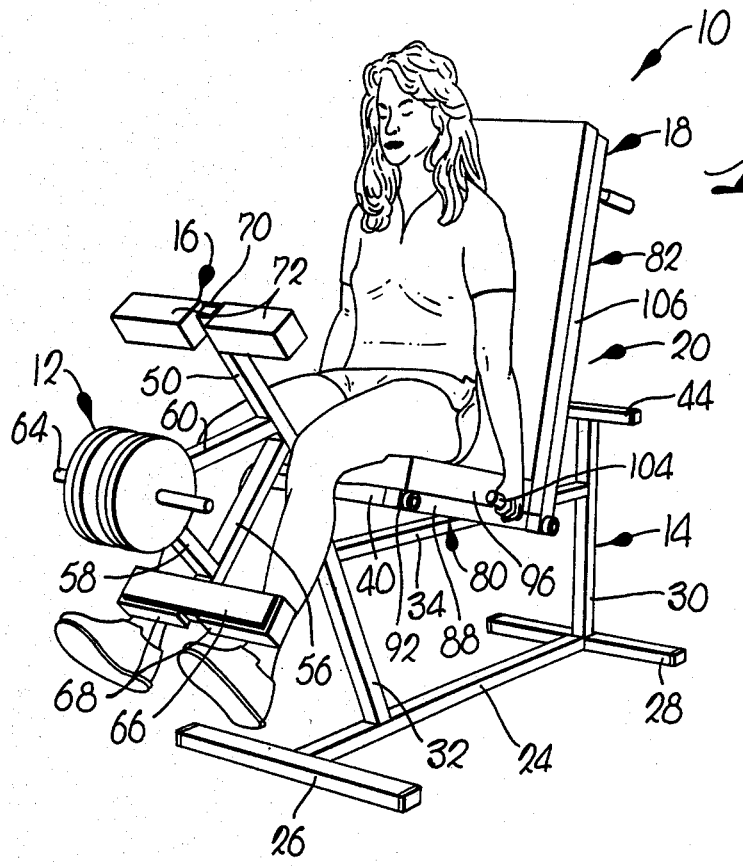
FIG. 1 is a perspective view of the device of the present invention in use in the first, sitting position.
Figure 2:
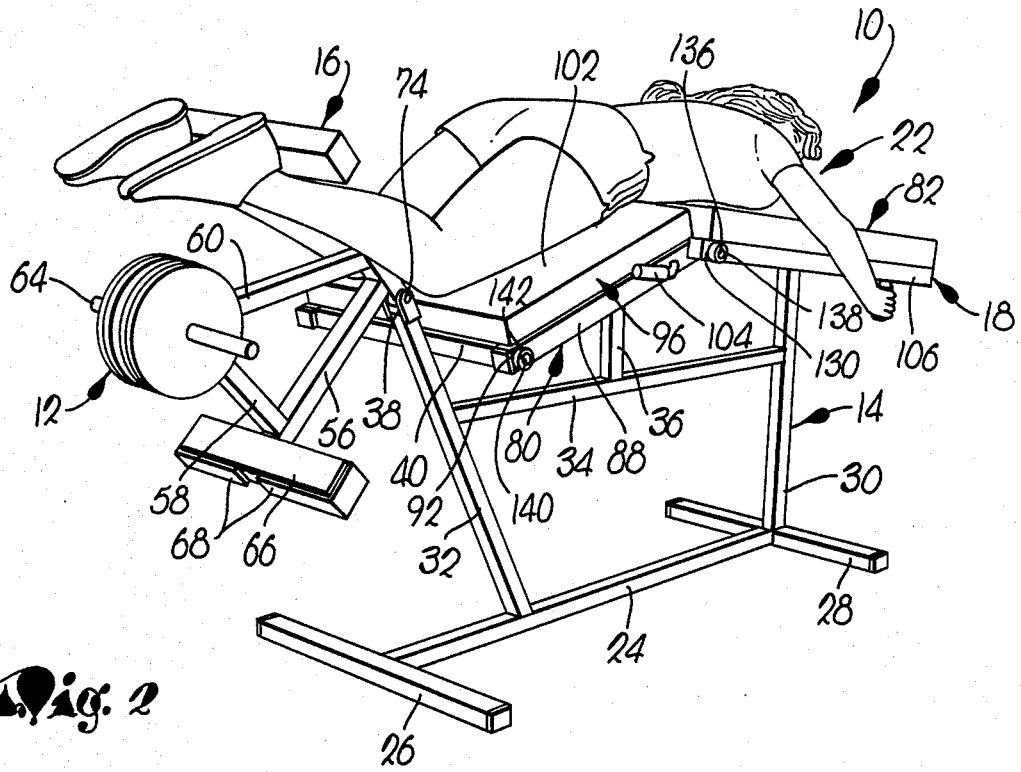
FIG. 2 is a perspective view of the present invention in use in the second, prone position.

Referring now to the drawings, a combined leg curl and extension exercise device 10 in accordance with the present invention is illustrated, which may be used in conjunction with one or more conventional free weights 12 as shown in FIGS. 1 and 2. Broadly speaking, the device 10 includes a frame structure 14 for supporting the device 10, an exercise unit 16 pivotally mounted to the frame 14, and an elongated, articulated bench 18 pivotally coupled to the frame 14 adjacent the exercise unit 16. Advantageously, the bench 18 may be alternatively adjusted and held in a first, sitting use position 20, ideally suited for exercising the quadricep leg muscles, and a second, prone use position 22, ideally suited for properly exercising the hamstring muscles of the leg (compare FIGS. 1 and 2).

Figure 6:
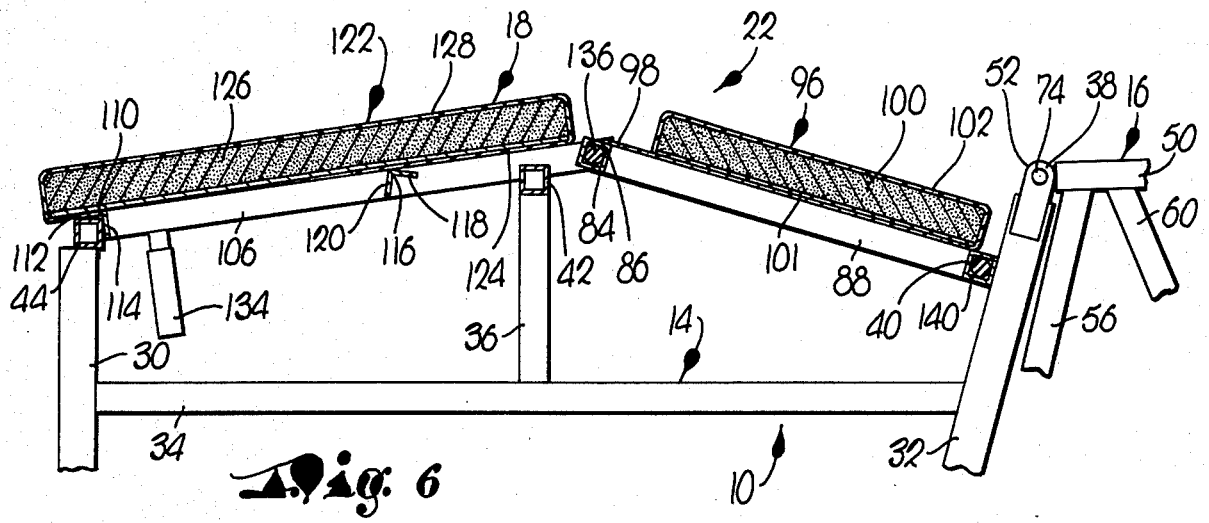
FIG. 6 is a partial, vertical sectional view of the device in the second position.

In more detail, the frame 14 includes an elongated, tubular, square in cross-section, floor-engaging member 24 and a pair of elongated, tubular, square in cross-section, floor-engaging members 26, 28 respectively secured (as by welding) at each distal end of the member 24. An elongated, square in cross-section, tubular, upright member 30 is fixedly secured to the member 28 adjacent the connection to member 24, in such a manner that the member 30 is oriented substantially perpendicular to both the members 24, 28. Another elongated, tubular, square in cross-section, upright member 32 is fixedly secured to the member 24 towards the interconnection to member 26, and is obliquely-oriented relative to member 24 and substantially coplanar with members 24, 30. Another elongated, tubular, square in cross-section member 24 is fixedly secured between members 30, 32 and is spaced, opposed, and substantially parallel to floor-engaging member 24. An elongated, tubular, square in cross-section, upright member 36 is affixed to member 34 approximately half way between members 30, 32 and is oriented substantially parallel to member 30. Member 32 includes a U-shaped, apertured clevis 38 secured to the uppermost, distal end thereof and an elongated, tubular square in cross-section member 40 defining an elongated bore 41 therethrough. Member 40 is transversely affixed to the member 32 intermediate the clevis 38 and the connection to member 34. Similarly, an elongated, tubular, square in cross-section member 42 is transversely proximaly affixed to the uppermost, distal end of member 36. Likewise, upright member 30 has an elongated, tubular, square in cross-section member 44 transversely proximally affixed to the uppermost distal end of member 30, and as seen in FIG. 6, the transverse members 40, 42, 44 are substantially parallel.

The exercise unit 16 includes an elongated, tubular, square in cross-section element 30 having an annularly shaped, centrally apertured socket 52, secured to one end of element 50. An elongated, tubular, square in cross-section element 56 is fixedly secured to element 50 adjacent the socket 52 and obliquely-oriented relative to element 50. A square in cross-section, tubular, elongated element 58 is fixedly secured substantially perpendicular to element 56 towards the distal end of element 56 opposite element 50. For support, another elongated, square in cross-section, tubular element 60 is obliquely affixed to element 50 adjacent the connection to element 56, with the element 60 additionally fixedly secured to the distal end of element 58 (see FIG. 3). The free end 62 of element 60 adjacent element 58 is transversely apertured to receive and secure (as by welding) a transversely extending, elongated, solid, cylindrical in cross-section weight-receiving bar 64.

As seen in the drawings, the elements 50, 56, 58 and 60 are fixedly interconnected (as by welding) such that they are all substantially coplanar. The element 56 additionally includes an elongated, flattened, rectangularly shaped plate 66 proximally fixedly secured to element 56 adjacent element 58. Advantageously, the plate 66 includes a pair of resilient pads 58 affixed thereto and oriented away from the element 62. Similarly, the element 50 incorporates an elongated, flattened, rectangularly-shaped plate 70 fixedly secured to the distal end of plate 50 opposite socket 52. Plate 70, likewise, incorporates a pair of resilient pads 72 affixed to plate 70 and oriented toward weight-receiving bar 64. As best seen in FIGS. 6–7, the exercise unit 16 is pivotally mounted to the frame 14 by the pivotal securement of socket 52 and clevis 38. To this end, a pin 74 is inserted through the respective apertures of socket 52 and clevis 38 by a set screw or other conventional means. As seen in FIGS. 1 and 2, this pivotal interconnection of socket 52 and clevis 38 allows the exercise unit 16 to pivotally rotate relative to frame 14.

The articulated bench 18 is split into two similar, flattened, padded bench portions 80, 82. In more detail, the first portion 80 is generally square in plan shape and includes a tubular, elongated, square in cross-section back member 84 defining an elongated bore 86 therethrough (FIGS. 6 and 7). A pair of similarly shaped, elongated, square in cross-section tubular members 88, 90 are perpendicularly affixed (as by welding) to each distal end of the back member 84 and oriented parallel to each other, with the members 84, 88, and 90 presenting a U-shaped configuration with the bore 86 exposed. Each member 88, 90 is apertured as at 92, 94 such that the apertures 92, 94 are aligned relative to each other and oriented parallel to the back member 84. A pad 96 is mounted on the members 84, 88, 90 and includes a complementally square shaped flattened base 98 affixed to the members 84, 88, 90 (as by gluing). A square-shaped, flexible cushion 100 is affixed to a similarly shaped, rigid back 101 (as by gluing) with the exposed portion of cushion 100 encapsulated in a synthetic flexible sheet material 102 (such as vinyl). The back 101 is then mounted to the base 98 (as by gluing), thereby completing the pad 96 of first portion 80. For purposes which will be made clear, the first portion 80 additionally includes a pair of L-shaped, obliquely-oriented, cylindrical handles 104 mounted on members 88, 90, respectively towards the joinder to back member 84.

The elongated, rectangularly shaped, second portion 82 is similar in construction to the first portion 80. A pair of elongated, square in cross-section, tubular members 106, 108 are oriented parallel to each other and spaced apart a distance slightly greater than the distance between first portion members 88, 90. An elongated, angle iron 110 having a flattened, rectangularly shaped first piece 112 perpendicularly interconnected to a second piece 114, is secured between members 106, 108 towards the distal end of the second portion 82 opposite first portion 80. A similarly shaped angle iron 116 having first and second pieces 118, 120, respectively, is secured between members 106, 108 parallel to and spaced apart from the angle iron 110. Advantageously, the angle irons 110, 116 are affixed between the members 106, 108 such that the included angles of the respective L-shaped angle irons are oriented away from each other (FIGS. 6 and 7). A resilient pad 122 is affixed to the members 106, 108 and broadly includes a rectangularly shaped, rigid, flattened base 124 secured between the members 106, 108 (as by gluing) adjacent the end opposite angle iron 110. A rectangularly shaped, flexible, resilient 126 (e.g. foam rubber) is affixed to a similarly shaped, rigid back 127 (as by gluing) with the exposed portion of cushion 126 then encapsulated in a flexible sheet material 128 (such as vinyl). The back 127 is then secured to the base 124 and portions of members 106, 108. The ends of members 106, 108 opposite angle iron 110 are apertured as at 130, 132 to present a set of aligned apertures oriented parallel to the angle iron 110. The structure of the second portion 82 is then completed by the addition of a pair of elongated, cylindrical handles 134 respectively to the members 106, 108 adjacent the angle iron 110 and oriented away from the pad 122.

The first and second portions 80, 82 of the bench 18 are hingedly interconnected by the sliding reception of the back member 84 between the members 106, 108 such that the apertures 130, 132 are aligned with the bore 86. In this position, an elongated, cylindrical in cross-section, solid axle 136 is received through the apertures 130, 132 and bore 86, whereupon an annular bushing 138 is secured at each exposed end of the axle 136 completing the hinged interconnection. The bench 18 is then pivotally coupled to the frame 14 in a similar fashion. That is, the distal ends of the members 88, 90 are received over the distal end of the frame member 40 such that the apertures 92, 94 are aligned with the bore 41. Another elongated, cylindrical in cross-section, solid axle 140 is received through the apertures 92, 94 and bore 41 and secured in place by the respective annular bushings 142.

In use, it is seen that the device 10 is easily adaptable between the first, sitting position 20 and the second, prone position 22, depending on the exercise desired. As best seen in FIGS. 1, 7, the first portion 20 of the bench 18 places the first and second portions 80, 82 approximately perpendicular to each other. In this regard, the first portion 80 is slightly upwardly angled to place the legs in a better position for exercise. As seen in FIG. 7, the bench 18 in the first position 20 is at least supported at two different locations, that is first at the pivotal coupling of the portion 80 to the member 40 and secondly, at the engagement of the angle iron 116 with the member 42. Additionally, it is seen that in the preferred embodiment, the angle iron 116 is affixed to the second portion 82 in such a position that the back member 84 engages the member 34, thereby providing a third support location for the bench 18 in the first position 20.

Figure 3:
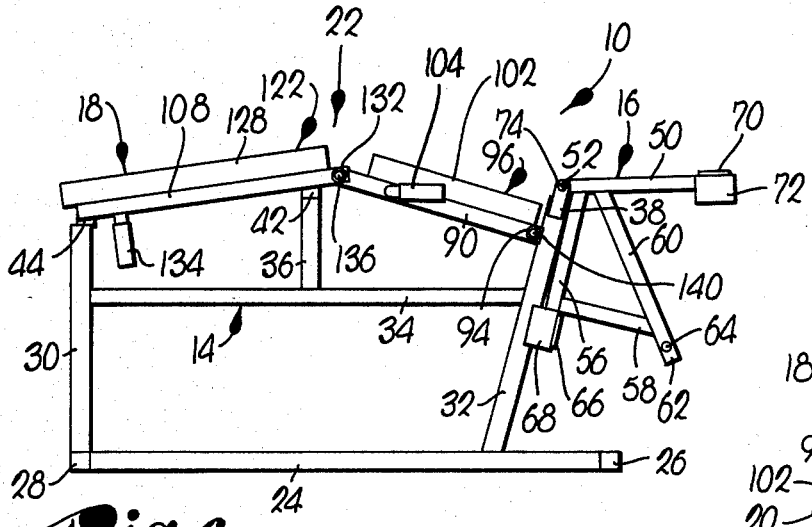
FIG. 3 is a side elevational view of the device in the second position thereof.
Figure 5:
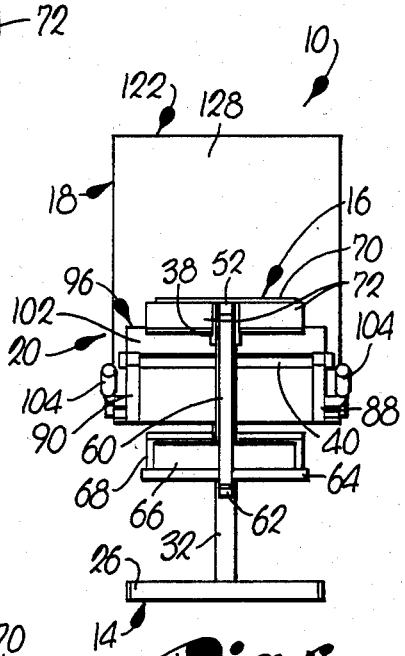
FIG. 5 is a front elevational view of the the device in the first position.
Figure 4:
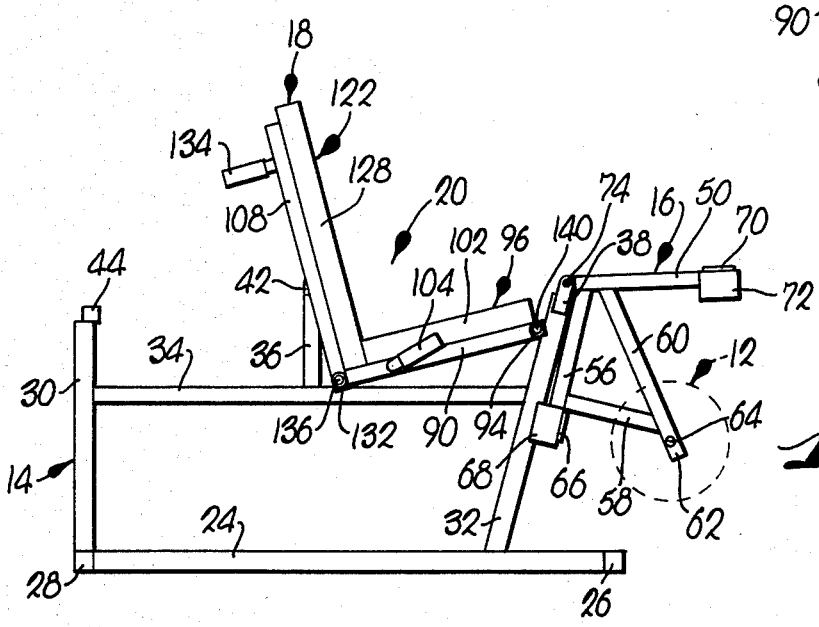
FIG. 4 is a side elevational view of the device in the first position thereof.

The simple connection between the angle iron 116 and member 42 allows the bench 18 to be easily transformable into the second, prone position as illustrated in FIG. 6. As seen in FIG. 6, the bench 18 in the second position 22 is supported only at two locations to the frame 14. First, the bench 18 is supported at the pivotal coupling of the first portion 80 to the member 40 and second, the bench 18 is supported by the engagement of the angle iron 110 to the member 44. As seen in FIGS. 3, 6 the bench 18 is held in this second position 22 by virtue of the fact that the distance along the bench 18 between the pivotal coupling member 40 to the angle iron 110 is greater than the straight line distance between the pivotal coupling member 40 and the member 44. Therefore, with the angle iron 110 engaging the member 44, the bench 18 is slightly upwardly bowed along the hinged connection between the portions 80, 82 and held in this gabled position by the separate engagement of the pieces 112, 114 to respective faces of the member 44. Thus, the angle iron 110 secures the bench 18 in a vertical direction and additionally upwardly biases the bench 18 in a bowed configuration. A seen in FIG. 6, the bench 18 in the second position 22 is slightly spaced from the member 42 receiving no support therefrom.

The configuration of the device 10 in the first, sitting position 20, as best seen in FIG. 1, places the body in a proper exercise position to exercise the quadricep muscles of the leg while fully supporting the back. Thus, the first position 80 ideally aligns the leg with the exercise unit 16 while the second portion 82 provides support the back. Further, the oblique orientation of the frame member 32 allows the exercise unit 16 to describe an arcuate path during exercise greater than 90°. This is particularly advantageous in that in exercising the quadricep muscles, the beginning of the exercise and the full extension of the leg are critical phases in developing the quadricep muscles. As those skilled in the art will appreciate, the handles 104, along with fully supporting the back and the slight upward angle of the legs, de-emphasizes the other muscle groups and ideally concentrate the exercise on the development of the quadricep muscles. As may be appreciated, there are many ways to vary the resistance of the exercise unit 16 to the pivoting exercise action, with the preferred embodiment showing the simple addition of conventional free weights 12 secured to the unit 16 as at weight-receiving bar 64.

In the second, prone position 22, as best seen in FIG. 2, exercising using the device 10 of the present invention optimally develops the hamstring muscles. By laying on the bench 18 in a prone position with the stomach approximately oriented over the hinged interconnection between the portions 80, 82, and grasping the handles 134, the body is ideally situated to emphasize the hamstring muscles. As those skilled in the art will appreciate, this angled orientation of the legs relative to the exercise unit 16 particularly allows the de-emphasis of the buttocks muscles during the exercise and further, allows the body to contact the bench 18 over a greater surface area, thus relieving the pressure on the kneecaps.

As seen in FIGS. 1 and 2, the device 10 of the present invention is easily used in either the quadricep or hamstring exercise. The bench 18 is easily adjustable between the first position 20 and the second position 22 to thereby optimally emphasize the desired muscle groups during exercise. Additionally, the incorporation of such an effective dual position bench into a single unit, results in a significant cost savings.

I claim:

1. A leg exercise device comprising:

a frame;

an articulated bench having substantially flattened first and second portions and means hingedly interconnecting said first and second portions, said bench being adjustable between a first position, wherein said first and second portions are transversely oriented relative to each other, and a second position, wherein said first and second portions present a gabled configuration;

means for pivotally coupling the end of said first bench portion, remote from said interconnection means, to said frame;

means for alternately securing said bench in said first and second positions including said pivotal coupling means;

an exercise unit presenting one or more leg-engaging structures and having means pivotally mounting said unit to said frame adjacent said pivotally coupled end of said first bench portion and in disposition for engagement of at least certain of said structures with the legs of a user positioned on said bench when said bench is in either of said positions, means for adjusting the resistance of said unit to pivoting.

2. An exercise device as claimed in claim 1, said exercise unit presenting a pair of elongated members each having a first end and a second end, said members being fixedly interconnected adjacent respective first ends thereof, such that said members are obliquely oriented relative to each other, said unit being pivotally mounted to said frame adjacent the interconnection of said members, each member including an elongated element, transversely secured thereto adjacent said second end thereof, said elements thereby defining said one or more leg-engaging structures.

3. An exercise device as claimed in claim 2, said resistance adjustment means presenting an elongated, cylindrical in cross-section bar affixed to said exercise unit and dimensioned for receiving one or more conventional, centrally-apertured, free weights.

4. An exercise device as claimed in claim 1, said resistance adjustment means including structure for incrementally coupling one or more weights to said exercise unit.

5. An exercise device as claimed in claim 1, said frame having first and second end and includes a base portion having a plurality of elongated, fixedly interconnected members connecting said frame first and second ends wherein portions of some of said members contact the floor, said frame first end including an upright, elongated support obliquely secured at one end to said base portion, said exercise unit being pivotally mounted adjacent the upper end of said support.

6. An exercise device as claimed in claim 1, said frame including substantially coplanar, spaced-part, upright, first, middle and second supports, and said bench first portion being pivotally coupled to said frame first support, wherein said bench in said first position is supported by said pivotal coupling to said frame and said middle support abutting said bench second portion, and said bench in said second position is supported by said pivotal coupling to said frame and said second support abutting said bench second portion.

7. An exercise device as claimed in claim 6, said bench securing means including an elongated element transversely fixedly secured to said second support and an elongated strut fixedly secured to said bench second portion proximal the end thereof remote from said hinged interconnection, the distance along the bench between the first portion pivotal coupling to said frame and said second portion strut being greater than the linear distance between said first portion pivotal coupling to said frame and said second support, said element and strut being complementally configured for engagement such that said bench in said second position is upwardly oriented along said first and second portion hinged interconnection presenting a gabled configuration whereby said element and strut engagement supports said bench one end in both the vertical and longitudinal directions thereby maintaining said gabled configuration of said bench.

8. An exercise device as claimed in claim 7, said element being square in cross-section and said strut being L-shaped and open ended, said included angle of said L-shaped piece being oriented away from said first and second portion hinged interconnection.

9. An exercise device adjustable for exercising the legs in either a sitting or prone position, said device comprising:

a frame including an elongated, floor-engaging base and three elongated, spaced-apart, upright, approximately coplanar first, middle, and last members affixed to said base;

an exercise unit presenting a pair of elongated first elements fixedly interconnected to each other adjacent one end thereof in oblique orientation, a pair of elongated second elements respectively transversely affixed to a corresponding first element adjacent the other end thereof, said unit being pivotally interconnected to said first, upright member adjacent the upperend thereof, and said unit including weight-receiving structure for varying the resistance of said unit to pivoting;

an elongated bench having a flattened, first portion pivotally secured at one end thereof to said first upright member in close proximity to said pivotal interconnection of said unit to said first member, and said bench having an elongated, flattened second portion hingedly interconnected at one end thereof to said other end of said first portion, and said second portion other end including means for securing said second portion to the upper end of said last upright member, means for alternately securing said bench in first and second positions wherein in said first position said first and second portions are oriented substantially perpendicular to each other and said second portion abuts said frame middle member, and in said second position wherein said bench is upwardly oriented along the hinged interconnection between said first and second portions thereby presenting a gabled configuration and said bench is supported at one end by said pivotal securement to said first member, said alternate securement means comprising said apart structures carried by said bench for engaging a plurality of said elongated, spaced-apart, upright members.

* * * * *